US005484376A

United States Patent [19]

Prader et al.

[11] Patent Number: 5,484,376

[45] **Date of Patent: * Jan. 16, 1996**

[54] READY TO LOAD BAG PACK, METHOD OF FORMING AND SYSTEM

[75] Inventors: Randolph D. Prader, Fairport; Graham Smith, Walworth, both of N.Y.

[73] Assignee: Mobil Oil Corporation, Fairfax, Va.

[ * ] Notice: The portion of the term of this patent subsequent to Feb. 11, 2009, has been disclaimed.

[21] Appl. No.: 308,860

[22] Filed: Sep. 19, 1994

Related U.S. Application Data

[62] Division of Ser. No. 152,781, Nov. 15, 1993, abandoned, which is a continuation of Ser. No. 529,806, May 29, 1990, abandoned, which is a continuation-in-part of Ser. No. 495,070, Mar. 19, 1990, Pat. No. 5,087,234.

[51] Int. Cl.[6] ..... B31B 23/86; B31B 27/60

[52] U.S. Cl. ..... 493/194; 493/204; 493/926

[58] Field of Search ..... 493/193–197, 493/210, 212, 267, 204, 926

[56] References Cited

U.S. PATENT DOCUMENTS

| | | | |
|---|---|---|---|
| 3,690,221 | 9/1972 | Schmedding | 93/35 RB |
| 4,120,716 | 10/1978 | Bonet | 156/272 |
| 4,165,832 | 8/1979 | Kuklies et al. | 229/54 R |
| 4,264,392 | 4/1981 | Watt | 156/272 |
| 4,365,716 | 12/1982 | Watt | 206/632 |
| 4,529,087 | 7/1985 | Neal et al. | 206/328 |
| 4,560,067 | 12/1985 | Reimann | 206/554 |
| 4,676,378 | 6/1987 | Baxley et al. | 206/554 |
| 4,744,200 | 4/1988 | Benoit, Jr; et al. | 53/447 |
| 4,785,938 | 11/1988 | Benoit, Jr; et al. | 206/554 |
| 4,796,759 | 1/1989 | Schisler | 206/554 |
| 4,811,417 | 3/1989 | Prince et al. | 383/9 |
| 4,854,999 | 8/1989 | Schirmer | 156/272 |
| 4,877,473 | 10/1989 | Snowdon et al. | 156/204 |
| 4,989,732 | 1/1991 | Smith | 206/554 |
| 5,020,750 | 6/1991 | Vrooman et al. | 248/97 |
| 5,062,927 | 11/1991 | Stout | 203/89 |
| 5,087,234 | 2/1992 | Prader et al. | 493/194 |
| 5,183,158 | 2/1993 | Boyd et al. | 206/554 |

FOREIGN PATENT DOCUMENTS 820818 11/1982 European Pat. Off. .

OTHER PUBLICATIONS

"Mechanism of Corona–Induced Self–adhesion of Polyethylene Film" by D. K. Owens, Journal of Applied Polymer Science, vol. 19, pp. 265–271 (1975).

*Primary Examiner*—Jack W. Lavinder
*Assistant Examiner*—Christopher W. Day
*Attorney, Agent, or Firm*—Alexander J. McKillop; George W. Hager, Jr.; Clinton H. Hallman, Jr.

[57] ABSTRACT

A thermoplastic film bag pack where each bag has a bottom, front, rear, and gusseted side walls, an inside and outside surface and a cut-edge mouth portion. The mouth portion has double film loop handles as integral extensions of the walls at its opposite ends. The external surface of the bag at the cut-edge region of the mouth between handles has been subjected to a corona discharge treatment to such an extent that adjacently facing cut-edge regions will be releasably adherent until a moderate force separates them. This condition provides for effective dispensing of grocery bags. A method of forming the bags and a system for dispensing is also disclosed.

16 Claims, 2 Drawing Sheets

READY TO LOAD BAG PACK, METHOD OF FORMING AND SYSTEM

RELATED APPLICATIONS

This is a divisional application of application Ser. No. 08/152,781, filed on Nov. 15, 1993, now abandoned, which is a continuation of application No. 07/529,806, filed May 29, 1990, now abandoned, which is a continuation-in-part of application No. 07/495,070, filed Mar. 19, 1990, now U.S. Pat. No. 5,087,234.

The present invention is concerned with a pack of bags of the thermoplastic film type wherein each bag is treated, structured, and used so that the foremost bag is always in an opened or partially opened condition and, thus, ready for filling without lost time spent accessing the bag mouth of each bag.

Since the commercial introduction of the plastic film grocery sack in the U.S. after about 1979, its acceptance has grown steadily because of its many advantages over paper grocery sacks. Because of the inherent lack of rigidity of the thin plastic film employed in manufacturing these bags, special means must be utilized for suspending the bag packs and for holding the foremost bag in the pack in a position most conducive for filling the bag. Long lines at the check-out counter of a supermarket are annoying to the customers and baggers. If the bagger, utilizing plastic bags, has to fumble with the opening of each bag, store-front productivity suffers. The store manager sees the slow-down as a loss of time, money and perhaps customers, all because of a less-than-fluid system of bagging groceries.

In 1989 a commercially available bag pack was observed which appeared to facilitate the system of bagging groceries utilizing thermoplastic film grocery bag packs. Each bag of the bag pack has become known as a T-shirt or undershirt grocery bag. Structurally, this is a bag made from a polyethylene film tube, collapsed, gusseted at the sides, sealed at the bottom, with an open mouth top and double film handles at opposite ends of the mouth. In use, this pack is suspended from the handles by way of orifices threaded onto spaced, separated parallel rods. Access to the bag mouth region of the first bag in the pack is gained and product is loaded into the bag. As the filled bag is removed from the system, the outside surface of the back of the filled bag adheres to the front film layer of the following bag. As the following bag encounters greater resistance to being moved, it separates from the departing bag. The following bag is left in a partially opened condition ready to be filled, and the process repeats itself. In an ideal system of this type, all hand fumbling with the mouth of the next bag would appear to be eliminated.

The system, however, is not ideal and a tendency for the bags to string together in a "paper doll"-like chain occurs too often. By this is meant that, on removal of a loaded bag, more than one bag is pulled forward by the departing bag. When this occurs, the result is worse than not having the system at all. This is because after one or more unfilled bags have been unintentionally removed from the parallel suspension rods, it takes more time than it is worth to reposition them back onto the rods. The more often that this occurs, the less effective is the system.

While applicants originally do not completely understand the mechanism involved in this dispensing system, it is now believed that the same result can be obtained if both external surfaces of each bag is corona discharge treated during manufacture of the bag packs. Applicants believe that the phenomenon observed can be made to result from placing corona discharge treated polyethylene film surfaces together, with a proper amount of pressure, since it is known that this will cause adhesion of the treated films. See the paper, *MECHANISM OF CORONA-INDUCED SELF-ADHESION OF POLYETHYLENE FILM* by D. K. Owens, Journal of Applied Polymer Science, Vol.19, pp. 265–271 (1975). This will not occur if only one surface is treated and this untreated surface placed into face-to-face contact with a treated surface or if two untreated surfaces are placed in face-to-face contact.

Where polyethylene film product is to have printed information on its surface, e.g., plastic grocery sacks, it is a common practice to treat the surface so as to alter its surface characteristics to make it more receptive to liquid ink. If this is not done, the ink will not "wet" the surface and conventional printing cannot be satisfactorily accomplished. The treatments of choice for many manufacturers is that of corona discharge treatment or flame treatment. Corona discharge treatment of one side of polyethylene grocery bags, as a preprinting requirement, has been practiced for over ten years. As indicated above, this one-sided treatment would not produce the above-mentioned adhesion affect. Lately, probably due to the demand for more advertising space, two-sided printing is becoming more popular. Two-sided printing will require two-sided treatment of some type.

It is the primary objects of the present invention to improve upon the dispensing system described above so that its reliability is significantly enhanced.

SUMMARY OF THE INVENTION

The present invention is concerned with a thermoplastic fil bag pack comprising a plurality of said bags stacked in at least general registration in a layflat condition, each of said bags comprising bottom, front, rear and side walls, an inside and outside surface and an open mouth top portion, said open mouth portion comprising an entrance region to the bag with handles located at opposite end regions thereof, at least part of the external surface of the bag at the open mouth region between said handles having been subjected to a corona discharge treatment to such an extent that the pressure and cutting action forming said bag mouth will cause adjacently facing corona discharge treated cut-edge regions to be releasably adherent until a moderate force separates them; and the external surface of at least one side of said bag in the cut-edge region of the handles of that side, being untreated with corona discharge.

The present invention is also concerned with a method of forming a pack of gusseted, polyethylene film, integrally extended handle bags comprising:

(a) providing a collapsed tube of polyethylene film;
(b) corona discharge treating the external surfaces of said tube in at least part of the regions which will become the cut-edges of the mouth of said bags and leaving untreated the external surface of at least one side of said tube in the regions which will become the cut-edges of the handles of that side;
(c) forming side gussets in said tube;
(d) transverse-sealing said tube at bag-length distances apart to form a series of end-sealed gusseted pillowcases;
(e) separating and stacking a plurality of said pillowcases in at least general registration; and
(f) applying pressure to one end of the stack and severing all the film layers along a line so as to form integrally-extended double-film loop handles and an open mouth region in each bag and simultaneously or sequentially forming handle support orifices in each handle.

The invention also relates to a system for suspending a pack of bags, for loading bags, for removing loaded bags and for automatically opening the next bag preparatory to loading, comprising in combination:

a pack of handled bags suspended on a rack from suspension orifices in the handles;

said rack comprising a pair of laterally-spaced, elongated support rods having leading ends;

said bag pack comprising a plurality of thermoplastic film bags stacked in at least general registration in a layflat condition, each of said bags comprising bottom, front, rear and side walls, an inside and outside surface and an open mouth top portion, said open mouth top portion comprising integrally extended handles located at opposite end regions thereof;

the external surface of at least a portion of the surface of each bag at the open mouth region between said handles having been subjected to a corona discharge treatment to such an extent that the pressure and cutting action forming said bag mouth will cause adjacently facing corona discharge treated cut-edge regions to be releasably adherent until a moderate force separates them;

at least one side of each bag in the cut-edge region of the handles of that side being untreated with corona discharge; and said system being such that during removal of a bag from the supported bag pack, at least a portion of the cut-edge region of the front wall of the bag mouth of the next bag will follow the bag being removed for a short distance before separation, thereby opening said next bag rendering it ready for loading.

DETAILED DESCRIPTION OF THE INVENTION

Figure 1:
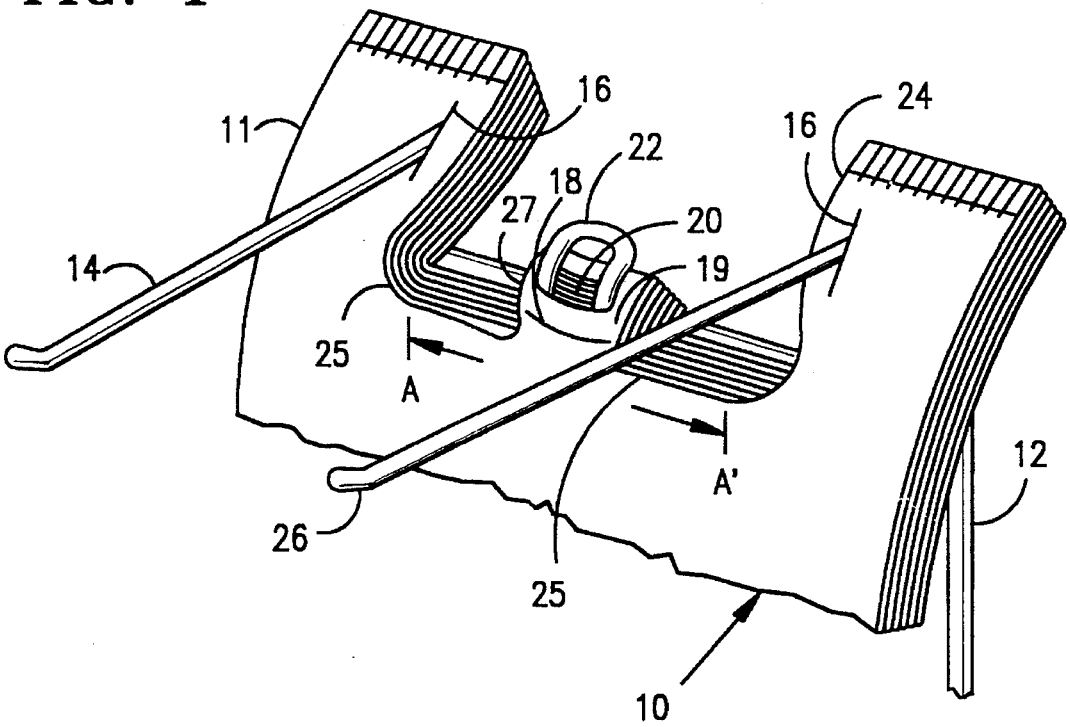
FIG. 1 is a partial perspective view of a bag pack and rack according to the invention.
Figure 2:
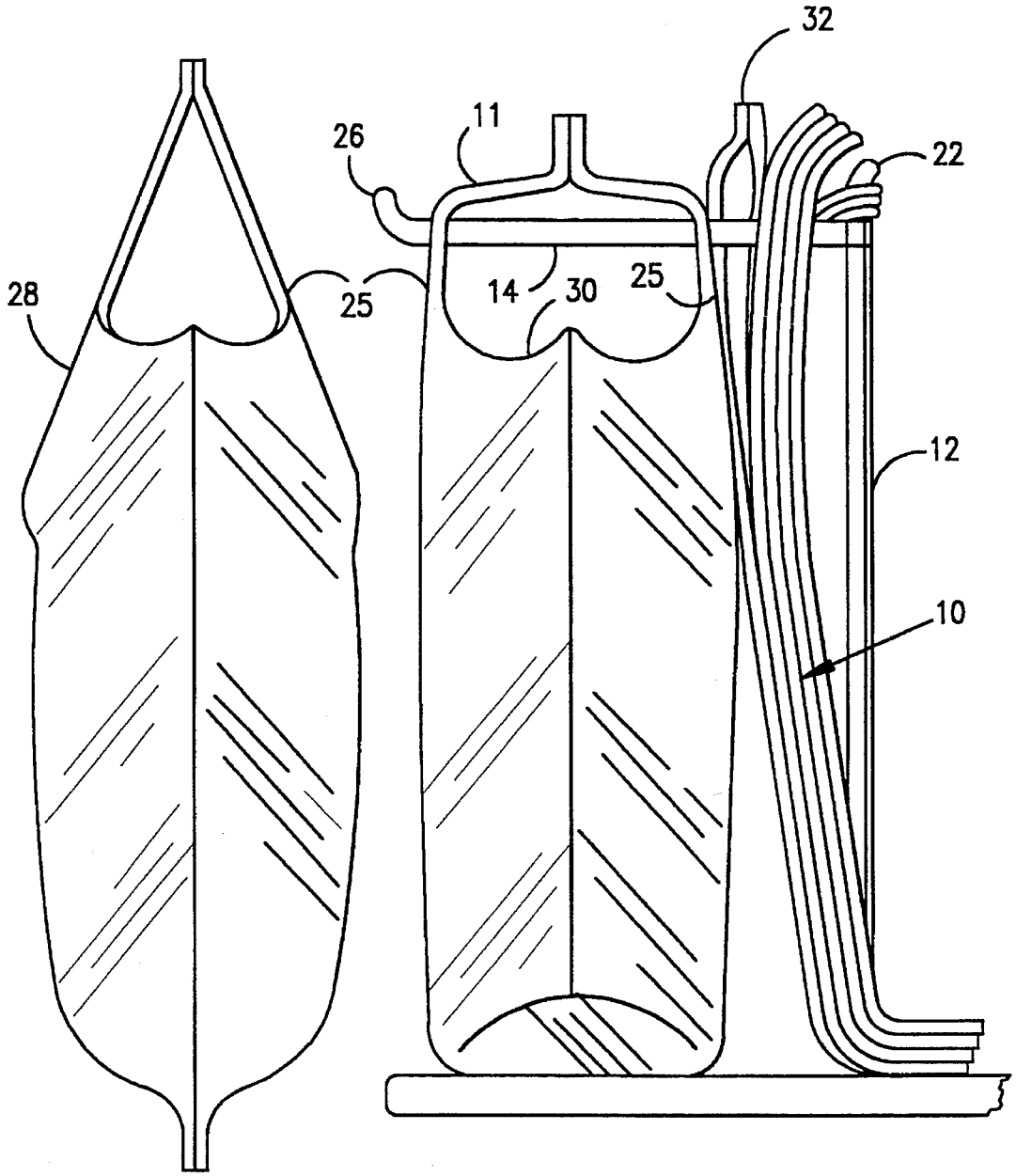
FIG. 2 is a side elevational view of a rack-mounted bag pack with several bags shown forwardly drawn therefrom.

In FIG. 1 there is shown a partial segment of a bag pack 10. The lower part of the bag is as shown in FIG. 2 and its details form no part of the invention disclosed herein. Pack 10 is shown suspended from rack 12. To accomplish this, the handles 11 are threaded onto spaced parallel arms 14 by way of slit orifices 16.

The individual bags of the bag pack shown have double-film loop handles by virtue of the fact that the bags were made from gusseted pillowcases, as is well known in the art. FIG. 2 shows handles 11 of bag 30 almost fully extended on support arms 14. FIG. 1 shows cut-line 24, which defines the inboard configuration of the handles, cut-line 25, which defines the bag mouth region and cut-line 27, which defines an optional center tab region used for center support of the bag pack. The center tab region includes an orifice 20 utilized for receipt of a suspension member, such as a tongue 22. When used, a separate tab is in association with the front and rear panels of each bag at the mouth region. The front tab has, near the base thereof, a severance line 18 which may be a continuous severance. In this case there is no connection between the front panel of the bag and the front tab. The front tab is just an artifact of the bag manufacture. The rear tab is connected to the rear panel of the bag by a series of narrow ties, made, for example, by perforating the film. When center tabs are used, each may be connected to their respective wall by equal strength ties or the front tab may be connected by weaker ties.

The essence of the invention is the provision of a bag pack and system which permits the reliable automatic opening of a following bag during removal of a loaded bag. This is accomplished by limiting the film adhesion, caused by corona discharge and pressure, to the outer film surface at the cut-edge of the bag mouth region of the bags. The aggressiveness of the adhesion should be enough to pull the front wall of a following bag forward and free of its back wall in the bag mouth region so that the following bag is properly postured to be loaded. The same is true in the instances when the optional center tabs are used. When the front tab is tied to the front wall at the bag mouth region, the adhesion between adjacent bag mouth surfaces must be strong enough to break these ties. If it were not, the bag being removed would merely peel away from the next bag and no part of it would follow the bag being removed.

The objects of the present invention are accomplished by pretreating the external surfaces of flattened tubular polyethylene film bag stock with corona discharge in the region of the film which will become the mouth of the bag but excluding from treatment at least one side of the film in the region which will become the cut-edge region of the handles of the bag. When the bag precursor film is treated in this manner, bag packs made and used according to this invention will manifest the automatic bag opening mentioned above.

Figure 3:
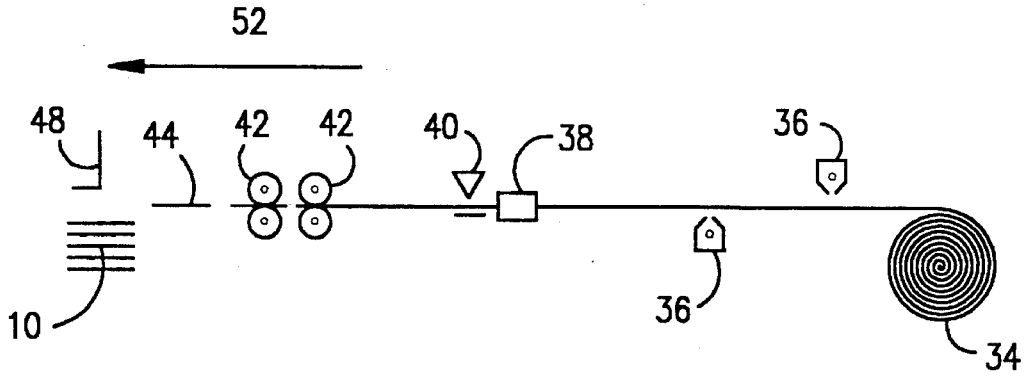
FIG. 3 is a side view of a schematic representation of the method of forming bag packs of the invention.
Figure 4:
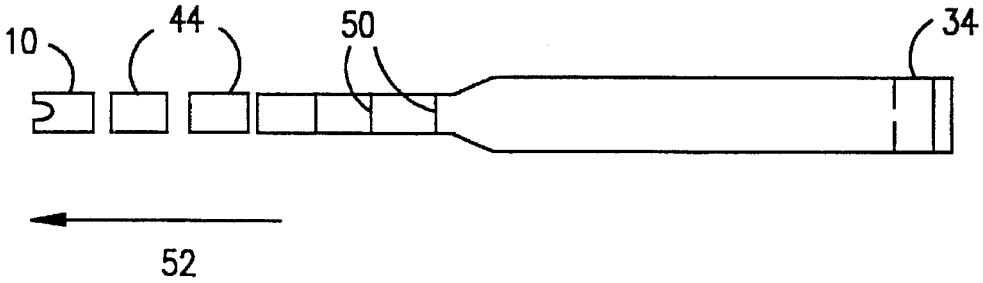
FIG. 4 is a plan view of the schematic of FIG. 3 absent the manipulative means.

FIGS. 3 and 4 illustrate schematically the formation of the treated bag packs. A convoluted roll 34 of a flattened tubular film is the precursor for the individual bags. This film material can be any thermoplastic material which can be treated with corona discharge so as to be utilizable in the system of the present invention. A suitable class of materials are the polyethylenes generically, including homopolymer polyethylene of high, intermediate or low density, linear low density copolymers of ethylene an another C3–C10 alpha-olefin, and any blends of the foregoing. The thickness of the film is that normally used for grocery bags and may range from about 0.3 to about 1.5 mils or greater. A preferred thickness is from about 0.45 to about 0.75 mils. Any size bag is contemplated but the ⅙ bbl. and smaller is preferred.

The film material is passed in the direction of arrow 52 between two oppositely disposed corona discharge treaters 36 positioned so as to treat the outside surfaces of the collapsed tube in the regions which will become the cut-edge regions of the bag mouth of each bag. This will involve the regions between A—A' as shown in FIG. 1. The region between A—A' is about 3 to 4 inches in a ⅙ bbl. bag. This region may be uniformly treated or it may be treated in interrupted areas, e.g., dot, squares, stripes, etc. It is only important that adjacently contacting treated surfaces have enough adhesion therebetween so that the mouth region of a next succeeding bag will open to a meaningful extent.

Corona discharge treatment equipment can be obtained from Solo Systems Inc., Garland, Texas; Corotec Corp., Collinsville, Conn.; and others. The film should be treated to a surface tension level of between about 40 to about 55 dynes/cm in accordance with ASTM Standard D2578-84. Using Solo Systems equipment, each treater can have an air gap of about 0.060 inch when treating LLDPE film of about 0.65 mils. As a specific example, the entire 3 to 4 inches in region A—A' is treated so as to include what will become the cut-edge region of the bag mouth. The film is treated to 42–44 dynes/cm. An inch or more below the bag mouth, the treated area can be extended up to the maximum width of the bag on one or both sides in order to accommodate the application of printed material which can be applied at any convenient place in the system, e.g., immediately after the treatment.

After this degree of treatment, the tube is passed through a gusseter 38 which will include a gusset of from about 3 to about 5 inches into both sides of the collapsed tube. The tube proceeds to a transverse heat seal means 40 of conventional design which imposes heat seals 50 at bag length distances apart. Such a heat seal means is usually a resistance strip or bar, positioned to put a transverse seal across the gusseted tube at bag length distances apart. The sealed tube then proceeds to a combination of differential speed rollers which separate the tube into end-sealed gusseted pillowcases 44. The pillowcases are then stacked to the appropriate number desired, e.g., 75, 100, 125, etc., and, either in line or at a remote location, a cutting device 48 applies pressure and cuts one end of the stack so as to remove plastic, leaving the shape of the handles, a bag mouth and the optional center suspension tabs in the bag pack. This cutting device 48 may also have means for including a suspension orifice in the handles of the bags. The orifice can be of any shape, e.g., a circle, a curved orifice, part of a circle with a flap remaining therein, a teardrop cutout, a zig-zag orifice, a straight slit orifice, etc., with the latter preferred.

It will be noted that the suspension orifices are located at about a midway position between the top and the base of the handles. This is critically important for the most efficient operation of the system of the present invention. Located midway permits the loop of the handles to spread open on the suspension rods 14 as shown in FIG. 2. Spreading the handle loops in this manner opens the bag. If the bags were suspended from the handles from a point above the top seals of the handles, as taught by some prior art, the handle loops would not be able to spread open because the support rods would be remote from the loops. Seconds and fractions of a second are extremely important when translated into the front end overhead costs of a supermarket. Any improvement which saves these short intervals of overhead expense is a significant advance in the art. The overall time saved by the present invention is considerable.

FIG. 4 shows in plan view the operation and results of carrying out the process of FIG. 3 which culminates in the formation of bag pack 10.

The pressure necessary to perfect the adhesion of the treated surfaces is supplied during the process step of cut forming the handles, bag mouth and the optional central support tabs. Thus, the mechanism shearing the top end of the sealed pillowcases to form the cutlines 24, 25 and optionally 27 also pressures the treated regions and assists in causing them to adhere together in the desired manner. To quantify this pressure is difficult, but any sensible pressure involved in the formation of the bag mouth of the bag pack is satisfactory for the necessary adhesion involved in this invention.

Referring to FIG. 2, bag 28 is a bag loaded with goods which has just been removed from the rack 12. During the process of removal, the adhesive force between bag mouth cut edge surfaces 25 of bags 28 and 30 has been overcome. Also during the process of removal, the front mouth region of bag 30, due to the adhesive force, followed departing bag 28 for a short distance and a bagger would have further extended the bag during initial loading to the posture shown in FIG. 2. Bag mouth regions 25, between bags 30 and 32 can be seen to be still in adherence and on removal of bag 30, bag 32 will be in a partially opened condition ready to be filled, and so on. Because the internal surfaces of the bags have not been corona discharge treated, there is no adhesion between these surfaces.

Although the present invention has been described with preferred embodiments, it is to be understood that variations and modifications may be resorted to, without departing from the spirit and scope of the invention, as those skilled in the art will understand. Such modifications and variations are considered to be within the purview and scope of the appended claims.

What is claimed is:

1. A method of forming a pack of gusseted, polyethylene film, integrally extended handle bags comprising:

(a) providing a collapsed tube of polyethylene film, said tube having internal and external film surfaces;
wherein said external film surface contain first regions which will become bag mouth cut-edge regions and second regions which will become bag handle cut-edge regions when the film surfaces are severed to simultaneously form integrally-extended double loop handles and open mouth cut-edge regions between said integrally-extended double loop handles;

(b) corona discharge treating at least part of the external film surface of said tube in the regions which will become the bag mouth cut-edge regions and leaving untreated the external film surface of at least one lateral side of said tube in the regions which will become one of the handle cut-edge regions;

(c) forming side gussets in said tube;

(d) traverse-sealing said tube at bag-length distances apart to form a series of end-sealed gusseted pillowcases;

(e) separating and stacking a plurality of said pillowcases in at least general registration;

(f) applying pressure to one end of the stack and severing all the film layers along a cut-edge line so as to form integrally-extended double loop handles and an open mouth region in each bag and simultaneously or sequentially forming handle support orifices in each handle, said bags in said stack being releasably adherent along at least part of said bag mouth cut-edge regions, with adhesion created solely by the combination of said severing and said pressure, in the absence of any added heat at said corona discharge treated bag mouth cut-edge regions of said external film surface of said tube.

2. The method of claim 1 wherein said corona discharge treating produces a film surface tension level of between about 40 to about 55 dynes/cm.

3. The method of claim 2 wherein said treating produces film surface tension level of from about 42 to about 44 dynes/cm.

4. The method of claim 1 wherein all of the external film surface of what will become the cut-edge regions of the bag mouth is corona discharge treated.

5. The method of claim 1 wherein selected portions of what will become the cut-edge regions of the bag mouth is subjected to said corona discharge treatment.

6. The method of claim 1 wherein handle suspension orifices are formed in said handles intermediate the top and base of said handles.

7. The method of claim 1 wherein a centrally located support tab with support orifice is formed in the bag mouth region of at least the rear wall of said bag.

8. The method of claim 7 wherein said tab is formed so as to be easily severable from said wall.

9. In a method of forming a pack of gusseted, thermoplastic film, handled bags comprising the steps of providing a collapsed polyethylene film tube having internal and external film surfaces, forming side gussets in said tube, traverse-sealing the tube at bag-length distances apart to form a series of end-sealed, gusseted pillow cases, separating and stacking a plurality of said pillowcases in at least general registration, cutting out a portion of one end of said stack to form bags having a bag mouth defined by integrally extended handles at opposite ends thereof and having bag mouth cut-edge regions between said handles, the improvement comprising:

(a) corona discharge treating at least part of the external film surface of said tube in the regions which will become the bag mouth cut-edge regions between said handles and leaving untreated the external film surface of at least one lateral side of said tube in the regions which will become the handle cut-edge regions of said tube when the film surfaces are severed to form bags having open bag mouth defined by integrally extended handles and having bag mouth cut-edge regions between said integrally extended handles, (b) forming a releasable adherent connection between adjacently facing corona discharge treated bag mouth cut-edge regions of said external film surface of said tube, said connection created by pressure generated as a result of the cutting out of one end of the pillowcase stack in the substantial absence of any added heat such that a moderate force will separate the bag mouth cut-edge regions.

10. The improvement of claim 9 wherein said corona discharge treating produces a film surface tension level of between about 40 to about 55 dynes.

11. The improvement of claim 10 wherein said corona discharge treating produces a film surface tension level of between about 42 to about 44 dynes.

12. The improvement of claim 11 wherein all of the external film surface of what will become the bag mouth cut-edge regions is corona discharge treated.

13. The improvement of claim 12 wherein handle suspension orifices are formed in said handles intermediate the top and base of said handles.

14. The improvement of claim 13 wherein a centrally located support tab with support orifice is formed in the bag mouth region of at least the rear wall of said bag.

15. The improvement of claim 14 wherein said tab is formed so as to be easily severable from said wall.

16. A method for creating a releasable adhesion between bag mouth cut-edge regions of adjacent integrally handled thermoplastic bags in a bag pack said bag pack formed by cutting a collapsed tube, having a external film surface, into segments and forming a stack of end-sealed pillowcases having external film surfaces comprising the steps of:

(a) corona discharge treating at least a part of the external film surface of said collapsed tube in regions which will become bag mouth cut edge regions and leaving untreated the external film surface of at least one lateral side of said collapsed tube in the regions which will become one of the handle cut-edge regions, and (b) applying pressure to one end of said stack and severing said stack along a cut-edge line to form a bag mouth cut-edge region, wherein said bags in said stack are releasably adherent along at least part of said bag mouth cut-edge region and wherein said pressure is supplied solely by a cutting action forming said bag mouth in the substantial absence of any added heat, at said corona discharge treated bag mouth cut-edge regions of said external film surface of said tube.

* * * * *